US006691661B2

(12) United States Patent
Lundgreen et al.

(10) Patent No.: US 6,691,661 B2
(45) Date of Patent: Feb. 17, 2004

(54) TUNED INDUCTION SYSTEM FOR A MOTORCYCLE

(75) Inventors: James Michael Lundgreen, Viroqua, WI (US); Jeffery John Bailey, Richland Center, WI (US); Brian C. Hanold, Richland Center, WI (US); Nathan Lawrence Oium, La Farge, WI (US); Brian W. Perkins, Richland Center, WI (US); Jason Harold Perkins, Richland Center, WI (US); Scott A. Sjovall, Westby, WI (US); Eric Orvis Wangen, Viroqua, WI (US); Geoffery D. Ziegahn, Richland Center, WI (US)

(73) Assignee: S & S Cycle, Inc., Viola, WI (US)

( * ) Notice: Subject to any disclaimer, the term of this patent is extended or adjusted under 35 U.S.C. 154(b) by 0 days.

(21) Appl. No.: 10/174,200

(22) Filed: Jun. 17, 2002

(65) Prior Publication Data

US 2003/0140882 A1 Jul. 31, 2003

Related U.S. Application Data

(63) Continuation-in-part of application No. 29/155,082, filed on Jan. 31, 2002.

(51) Int. Cl.[7] ..... F02M 35/10

(52) U.S. Cl. ..... 123/184.31; 123/54.4

(58) Field of Search ..... 123/54.4, 184.31

(56) References Cited

U.S. PATENT DOCUMENTS

| | | | | |
|---|---|---|---|---|
| 4,364,340 A | | 12/1982 | Kimura | |
| RE31,877 E | | 5/1985 | Nomura | |
| 4,592,311 A | | 6/1986 | Makino | |
| 4,862,839 A | * | 9/1989 | Bridges | 123/184.32 |
| 5,205,244 A | | 4/1993 | Nakamura et al. | |
| 5,251,583 A | | 10/1993 | Shiohara | |
| 5,301,767 A | | 4/1994 | Shiohara | |
| 5,560,446 A | | 10/1996 | Onishi | |
| 5,577,570 A | | 11/1996 | Shiohara et al. | |
| 5,908,079 A | | 6/1999 | Amino | |
| 6,209,502 B1 | * | 4/2001 | Davis et al. | 123/184.32 |
| 6,510,823 B2 | * | 1/2003 | Hirano et al. | 123/54.4 |

* cited by examiner

*Primary Examiner*—Noah P. Kamen
(74) *Attorney, Agent, or Firm*—Merchant & Gould P.C.

(57) ABSTRACT

An tuned induction system for use on a motorcycle having a V-twin engine. The tuned induction system having separate and individual first and second manifold bodies. Each of the separate intake manifold bodies having a flange that couples the individual manifold body to a cylinder head of the V-twin engine. The flange having a continuous radius that maximizes airflow velocity to enhance engine performance.

20 Claims, 9 Drawing Sheets b
62
60
10
a
a
64
54
100
50
102
52
104
114
106
116
126
124
118
108
b
L1

TUNED INDUCTION SYSTEM FOR A MOTORCYCLE

CROSS REFERENCE TO RELATED APPLICATION

This application is a continuation in part of U.S. design application Ser. No. 29/155082, filed on Jan. 31, 2002, and incorporated herein by reference.

TECHNICAL FIELD

The principles disclosed relate to an induction system for use on a motorcycle engine. More particularly, this disclosure concerns a tuned induction system for use on a V-twin motorcycle engine.

BACKGROUND

In general, internal combustion engines, whether for use in an automobile, motorcycle or other machinery, operate by drawing clean filtered air into a carburetor or a fuel-injected manifold. The air is mixed with fuel to form an air-fuel mixture or charge that is drawn into each cylinder of the engine and combusted. Combustion of the air-fuel charge produces mechanical horsepower. Horsepower is a significant factor in many consumers' purchases of engines. Thus, many performance factors have been modified to increase engine volumetric efficiency and horsepower including structural variations of engine components and variations concerning the air-fuel charge.

In modifying engines to enhance performance, it is desirable to increase horsepower without increasing fuel emissions and fuel costs to operate the engine, or affecting engine durability. Therein, some design variations have been directed toward increasing horsepower by modifying the air intake component of the air-fuel charge. Although such design variations are commonly found in general internal combustion engines used in larger machinery applications, design variations of the air intake component of the air-fuel charge are limited for motorcycle applications.

As is well known, the extremely compact nature of a motorcycle gives rise to a number of design constraints. For instance, in modifying the air intake component of a motorcycle, placement of the induction system and charge forming devices is limited. This limitation is significant when designing an air intake or induction system that must fit within the small space between cylinder heads of a V-shaped or V-twin engine. Generally, V-twin engines have internally opposing air intake ports located on each of the V-angled front and rear cylinder heads. It is desirable to improve the induction systems for V-twin motorcycle engines to increase horsepower and torque without substantially increasing the V-angle and hence the overall size of the motorcycle engine.

One such improvement of an induction system involves using the advantages of a ram-air intake design. A number of arrangements have been proposed for providing ram air ducts on a motorcycle that supply air to the engine induction system. For example, arrangements have been provided wherein the cowling of the motorcycle itself forms an air duct for the induction system or wherein the frame is formed as an air duct for the induction system. None of these constructions, however, are feasible for use with a V-twin engine.

In general, improvement has been sought with respect to V-twin induction system designs to increase engine volumetric efficiency and horsepower without compromising fuel economy, emissions, or engine durability.

SUMMARY

One aspect of the present invention relates to an air induction system having a first manifold body and a second manifold body. Each of the first and second manifold bodies is in fluid communication with respective first and second intake runners. The manifold bodies are configured to fit between the first and second cylinder heads of a V-twin engine.

Another aspect of the present invention relates to an air induction system having separate intake passages corresponding to a first and second cylinder head of a V-twin engine. The separate intake passages each include portions having integral flanges that couple the induction system to the cylinder heads.

These features of novelty and various other advantages, which characterize the invention, are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION

With reference now to the various figures in which identical elements are numbered identically throughout, a description of various exemplary aspects of the present invention will now be provided.

I. General Motorcycle Description

Figure 1:
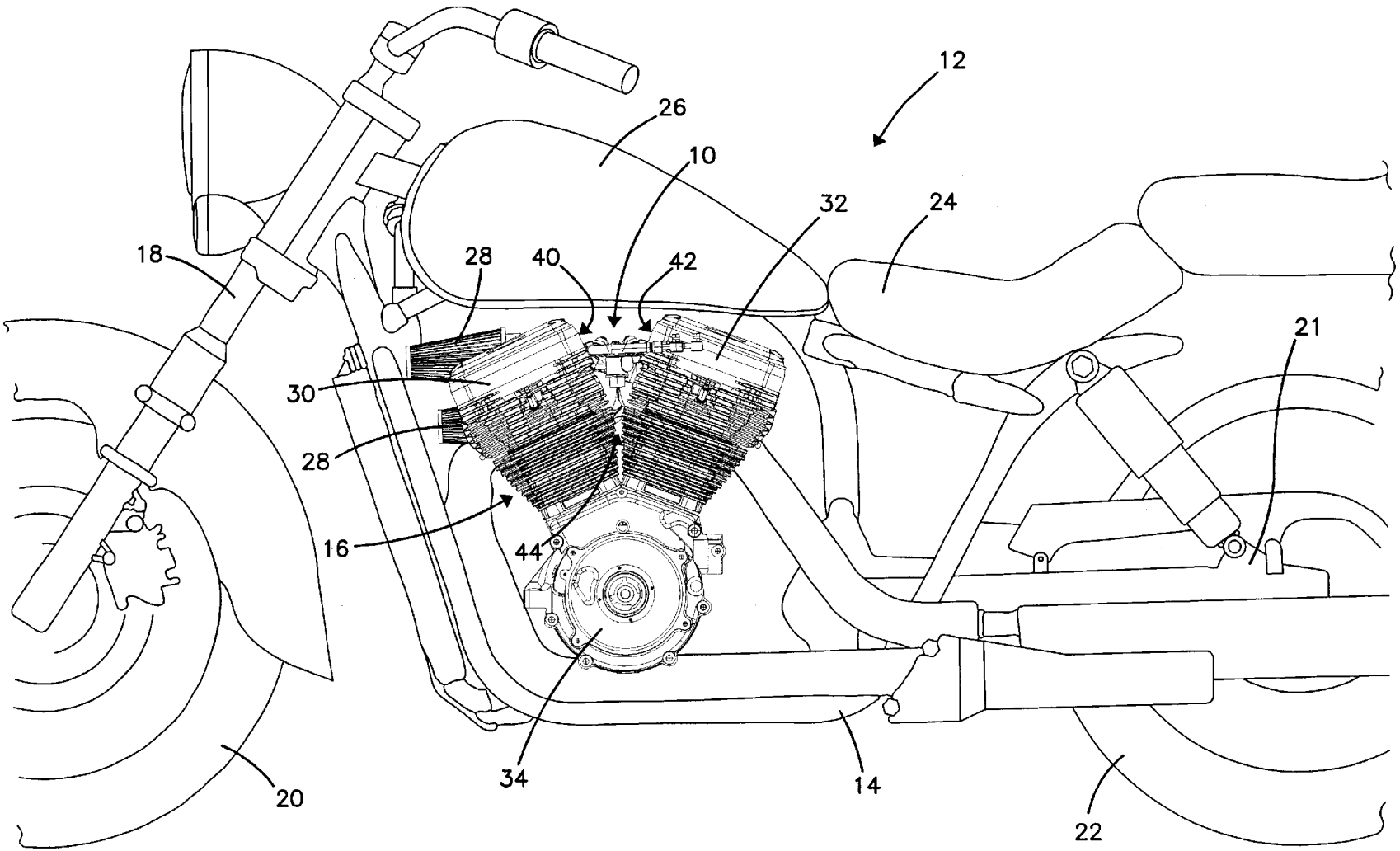
FIG. 1 is a left side elevation view of a motorcycle having a V-twin engine and a tuned induction system according to the principles disclosed.

FIG. 1 illustrates a motorcycle 12 having a frame assembly 14 supporting a front fork assembly 18 and a rear wheel assembly 21. The front fork assembly 18 journals a front wheel 20 for steering movement in a known manner. The rear wheel assembly 21 include a rear wheel 22 supported by a trailing arm mechanism and suitable suspension (not shown). A seat 24 is supported on the frame assembly 14 above the rear wheel 22. A fuel tank 26 is carried by the frame assembly 14 forwardly from the seat 24.

The motorcycle 12 is powered by an internal combustion engine 16. The internal combination engine 16 illustrated includes a tuned induction system 10. It is noted that although the engine 16 is illustrated in use with a motorcycle, it will be readily apparent to those skilled in the art that the engine may be employed in conjunction with other applications.

The tuned induction system 10 of the present invention, however, has particular utility in conjunction with a motorcycle having a V-type or V-twin engine. Specifically, the tuned induction system 10 provides a very compact yet highly efficient induction system for a V-twin engine. The efficiency of the induction system provides consumers' added horsepower and torque. In addition, the compactness is particularly important with motorcycles generally for obvious reasons; but is more important with V-twin motorcycles having internally opposing air intake ports.

II. Engine

The tuned induction system illustrated is for use on fuel injected V-twin motorcycles engines, such as those manufactured by Harley Davidson and others manufacturing engines of comparable architecture. Although the tuned induction system is herein described in operation with a V-twin engine, it should be readily apparent to those skilled in the art how the invention can be practiced in operation with engines having other configurations.

The V-twin engine 16 illustrated generally mounts within the frame assembly 14 and includes a front cylinder head 30 and a rear cylinder head 32. As is typical with motorcycle engines, the V-twin engine 16 includes a crankcase transmission 34 having a crankshaft and a speed transmission assembly (not shown) that drives the rear wheel 22 by a shaft or chain drive (not shown). The front cylinder head 30 extends upwardly and is inclined in a forward direction from the crankcase transmission 34. The rear cylinder head 32 extend upwardly and is inclined in a rearward direction from the crankcase transmission 34. Each cylinder head 30, 32 has a compression chamber formed therein. The compression chamber generally includes an intake port and an exhaust port.

In the illustrated V-twin engine embodiment, the intake ports of the front and rear cylinder heads are located in an opposing orientation. Specifically, the front cylinder head 30 is oriented generally 45 degrees relative to the rear cylinder head 32 to form a V-shape. An inner face 40 of the front cylinder head 30 faces toward an inner face 42 of the rear cylinder head 32. A V-shaped space 44 is provided between the inner surfaces 40 and 42. Intake ports of the front and rear cylinder heads 30 and 32 are located on each of the inner faces 40 and 42 in opposing orientation. The tuned induction system 10 is connected to the intake ports formed on the inner faces 40 and 42 of the front and rear cylinder heads 30 and 32.

III. Tuned Induction System

Figure 2:
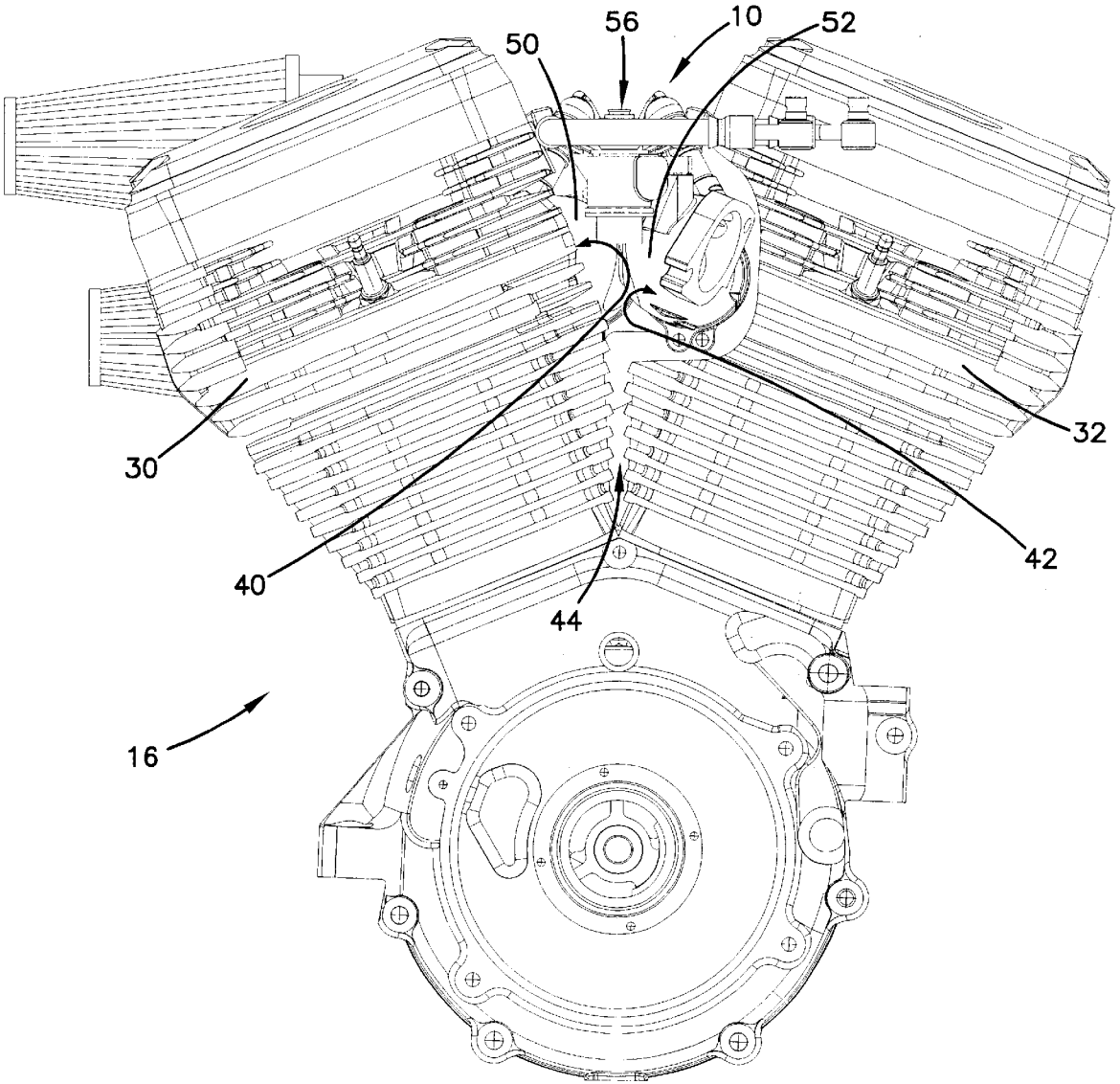
FIG. 2 is an enlarged left side elevational view of the V-twin engine shown cut away to illustrate the tuned induction system shown in FIG. 1.
Figure 3:
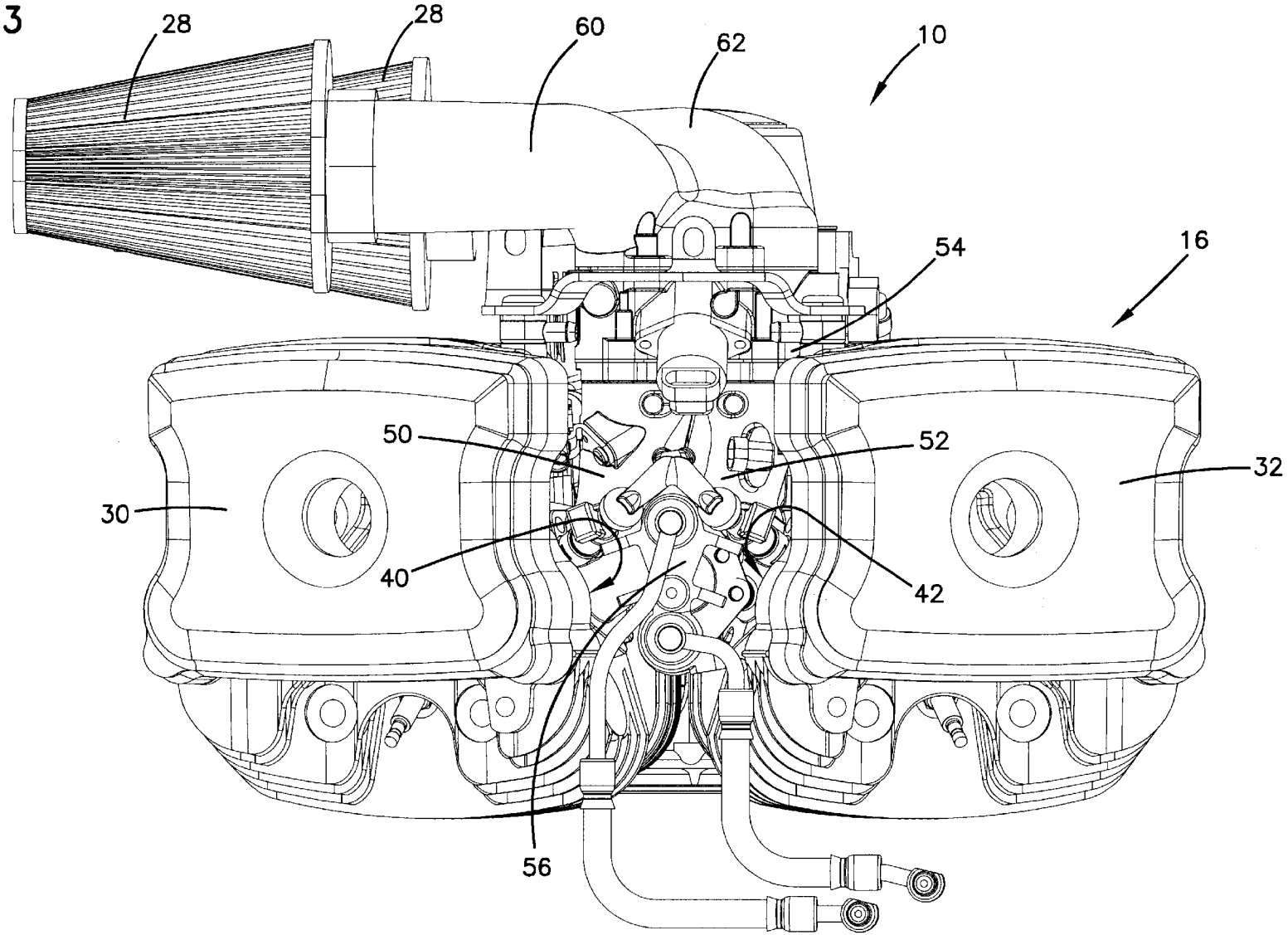
FIG. 3 is a top plan view of the V-twin engine (without the cut away) and the tuned induction system shown in FIG. 2.

The tuned induction system 10 provides an intake charge (a mixture of fuel and air) that is drawn into the front and rear cylinder heads 30 and 32, as is typical with V-twin engines. As best shown in FIGS. 2 and 3, the tuned induction system 10 of the present invention generally has separate front and rear manifolds 50 and 52, a throttle body 54, a fuel assembly 56, and separate front and rear air columns or intake runners 60 and 62.

A. Runners

Figure 4:
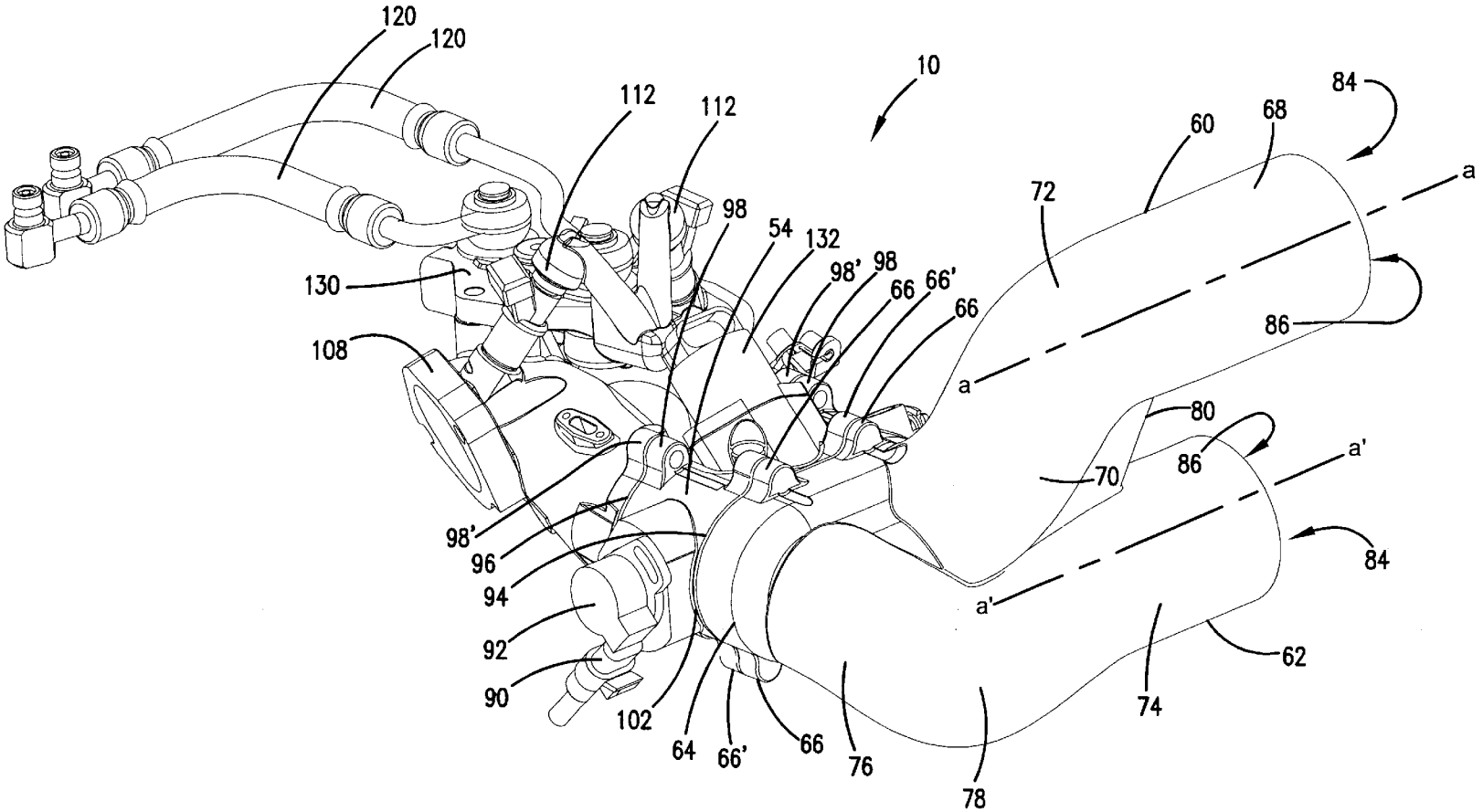
FIG. 4 is a right side rearward perspective view of the tuned induction system shown in FIG. 3.
Figure 5:
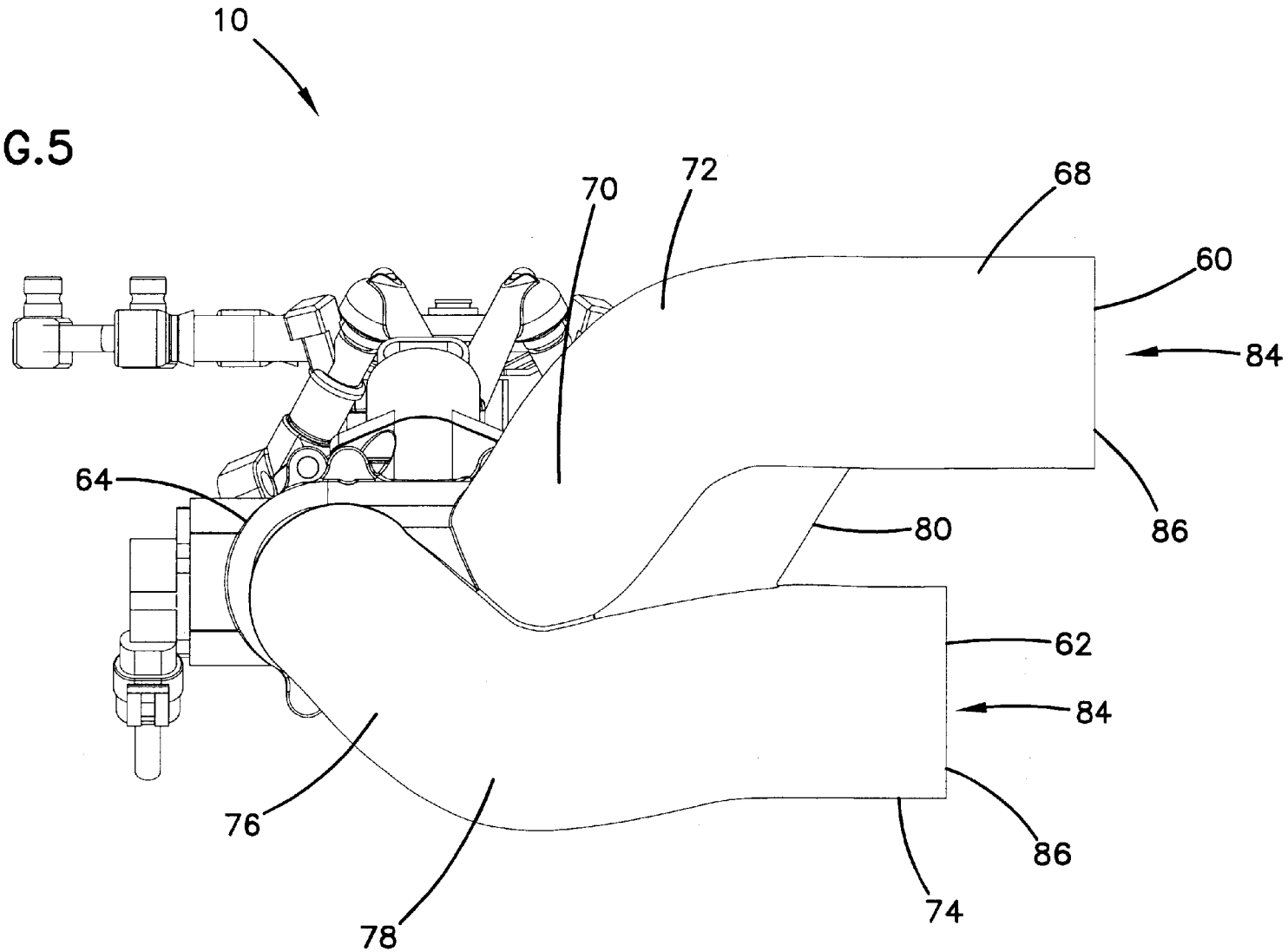
FIG. 5 is a right side elevational view of the tuned induction system shown in FIG. 4.

The air columns or runners 60 and 62 of the preferred embodiment face forwardly in relationship to the motorcycle 12. This orientation assists to create a ram air effect. As best shown in FIGS. 4 and 5, each of the front intake runner 60 and the rear intake runner 62 are individually constructed and extend from a unitary flange portion 64. The flange portion 64 includes lugs 66 at which the flange portion 64 mounts to the throttle body 54. In the illustrated embodiment, four lugs 66 extend radially from the flange portion (one lower lug is not shown).

The front and rear intake runners 60 and 62 are generally hollowed air columns or tubing having openings 84 at open ends 86. An air filter 28 (shown in FIGS. 1 and 3) for cleaning intake air used for combustion may be provided at the open ends 86. Other types of air filter configurations are contemplated, such as a unitary air filter that connects to both runners.

The front intake runner 60 has a first intake portion 68, a second intake portion 70, and a transition region 72. The transition region 72 is located between the first and second intake portions 68 and 70. In the preferred embodiment, the first intake portion is a linear portion 68 and the second intake portion is an angled portion 70. The transition region 72 gradually integrates the linear portion 68 and the angled portion 70. The linear portion 70 extends forwardly in relation to the motorcycle 12. The transition region 72 curves downward toward the angled portion 70 gradually directing the airflow entering from the opening 84 at the linear portion 68 to the angled portion 70. The angled portion 70 couples to the flange portion 64.

Figure 7:
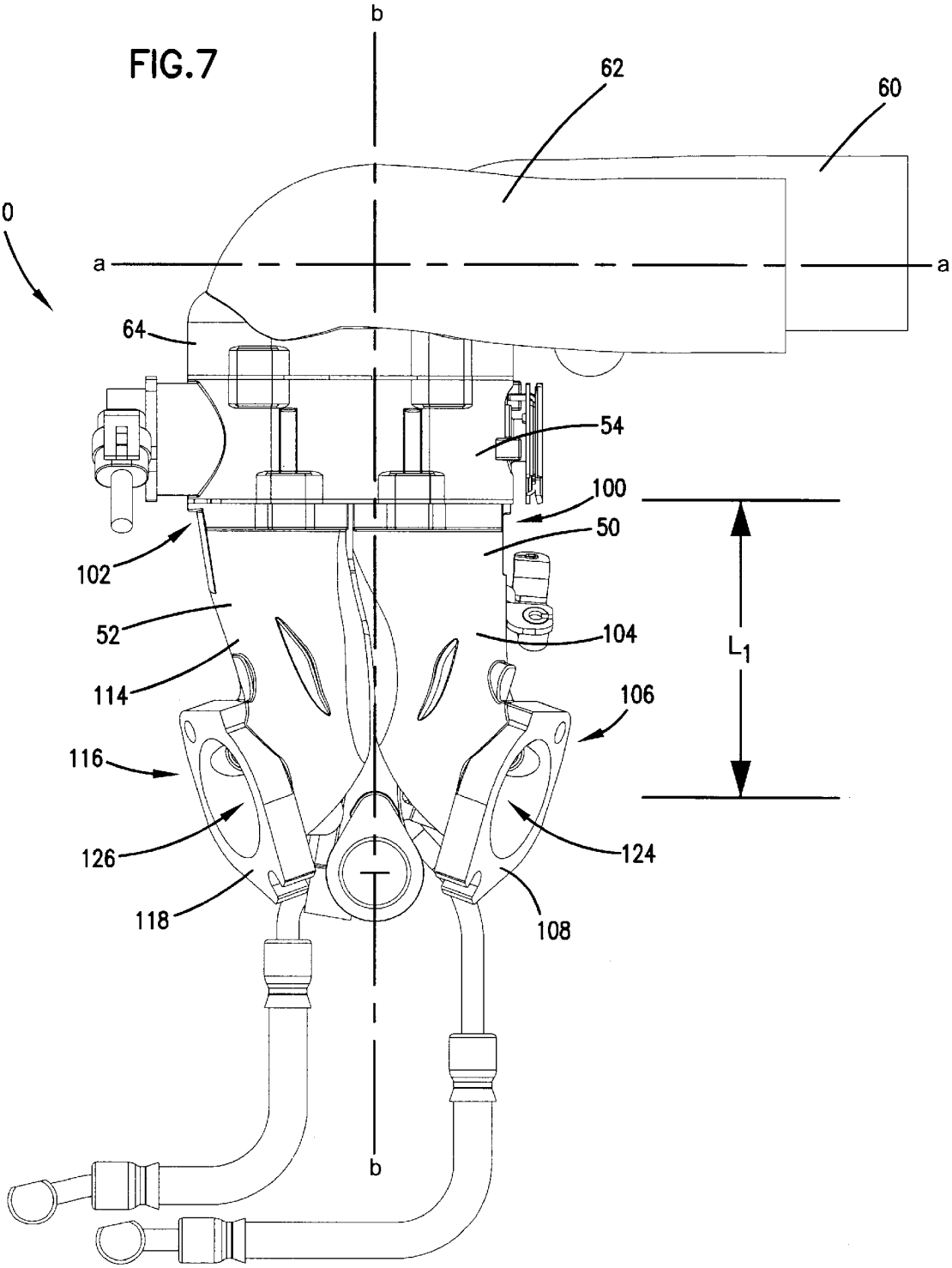
FIG. 7 is a bottom plan view of the tuned induction system shown in FIG. 6.

As best shown in FIGS. 4 and 7, the flange portion 64 has a face located toward the throttle body 54 or in a direction facing a longitudinal axis b—b of the overall induction system 10. Accordingly, the flange face is oriented generally perpendicular from the openings 84 of the linear portion 68. The direction of intake airflow is therefore required to make a 90-degree turn from the linear ram-air direction, shown generally along a transverse axis a—a of the intake runners 60 and 62 to a direction along the longitudinal axis b—b of the overall induction system 10. This re-directional ram air turn is limited by the configuration of the intake ports on the engine 16. In particular, ram air is received in first direction along the traverse axis a—a. To direct airflow to the intake ports on the inner faces of the cylinder heads, the airflow must be re-directed perpendicular from the first direction (a—a).

The overall configuration of the front intake runner 60 transitions the intake airflow passage downward and inward. This transition adds airflow travel length to maximize cylinder filling via pressure waves and air column inertia. This enhanced airflow travel length configuration rams additional air into the cylinder to increase engine performance.

Similarly, the rear intake runner 62 has a first intake portion 74, a second intake portion 76, and a transition region 78 located between the first and second intake portions 74 and 76. In the preferred embodiment, the first intake portion is a linear portion 74 and the second intake portion is an angled portion 76. The transition region 78 gradually integrates the linear portion 74 and the angled portion 76. The linear portion 74 extends forwardly in relation to the motorcycle 12. The transition region 78 curves upwardly toward the angled portion 76 gradually directing the airflow entering the opening 84 at the linear portion 74 toward the angled portion 76.

Again referring to FIGS. 4 and 7, the direction of airflow is required to make a 90-degree turn from the linear ram-air direction, shown generally along the transverse axis (a—a) of the intake runners 60 and 62 to a direction along the longitudinal axis b—b of the overall induction system 10. The overall configuration of the rear intake runner 62 transitions the intake airflow passage upward and inward. This transition adds airflow travel length to ram additional air into the cylinder.

The separate, individual intake runners 60 and 62 have predetermined lengths so that the overall lengths of the air passages of the induction system enable pressure waves to propagate and air column inertia to develop to enhance engine performance. The intake runners are also designed so that air intake characteristics of the front intake runner 60 and manifold 50 and air intake characteristics of the rear intake runner 62 and manifold 52 are nearly equalized.

In general, the overall lengths of each runner 60, 62, from the open ends 86 to the flange portion 64, are substantially the same. Experimentation to increase engine performance has shown that the overall length of each intake runner is preferably between 8 inches and 15 inches. More preferably the length is about 9 inches. Each of the runners 60, 62 also has an inside diameter that tapers from the open end 86 along the overall length of the runner. The taper improves performance by more efficiently reflecting pressure wave energy. Preferably the diameter at the open end 86 is between 2.5 inches and 1.85 inches, more preferably about 2.18 to 1.95 inches. The length, diameter and taper of each runner may be modified to optimize the ram air intake in accordance with the principles disclosed to accommodate variations in an engine configuration or the induction system and further enhance engine performance.

In the illustrated embodiment a fin 80 extends between the front intake runner 60 and the rear intake runner 62. The fin 80 includes a mounting location 82 (best shown in FIG. 6) at which the induction system 10 couples to the frame assembly 14.

B. Throttle Body

The flange 64 of the intake runners mounts to the throttle body 54 at corresponding lugs 66' located adjacent a first side 94 of the throttle body 54. Preferably, the throttle body is a two-barrel throttle body having two barrels or bores (not shown) that correspond to the separate, individual intake runners 60 and 62. The two bores extend through the throttle body from the first side 94 to a second side 96 opposite the first side 94. In the preferred embodiment, the throttle body 54 is a single piece construction. It is contemplated that two throttle bodies each individually mounted to each of the manifolds and corresponding intake runners may also be used in accordance with the principles disclosed.

In general operation, a throttle cable affixed to a suitable throttle actuator (not shown) operates a throttle control lever (not shown). The throttle control lever controls the rotation of throttle valve shafts (not shown) that open and close butterfly plates located within each of the throttle body bores (not shown). A throttle position sensor 92 cooperates with the throttle control lever for providing a signal to a controller (not shown) that regulates the fuel supply to the engine. This throttle valve assembly (as described generally) is controlled in accordance to the operating condition of the engine. For instance, the butterfly plates are only partially open when the rotational speed of the engine is low and the engine load is light. The butterfly plates are completely open when the rotational speed of the engine is high and the engine load is heavy. In the embodiment illustrated, an idle air control motor 132 is located adjacent the throttle body 54 to regulate air intake when the engine is idling.

Referring still to FIGS. 4 and 7 the second side 96 of the throttle body 54 includes lugs 98 that couple to an air intake end 100 and 102 of each of the front and rear manifolds 50 and 52. In the illustrated embodiment, four lugs 98 extend radially from the second side 96 of the throttle body 54 (one lower lug is not shown).

C. Manifold

Figure 6:
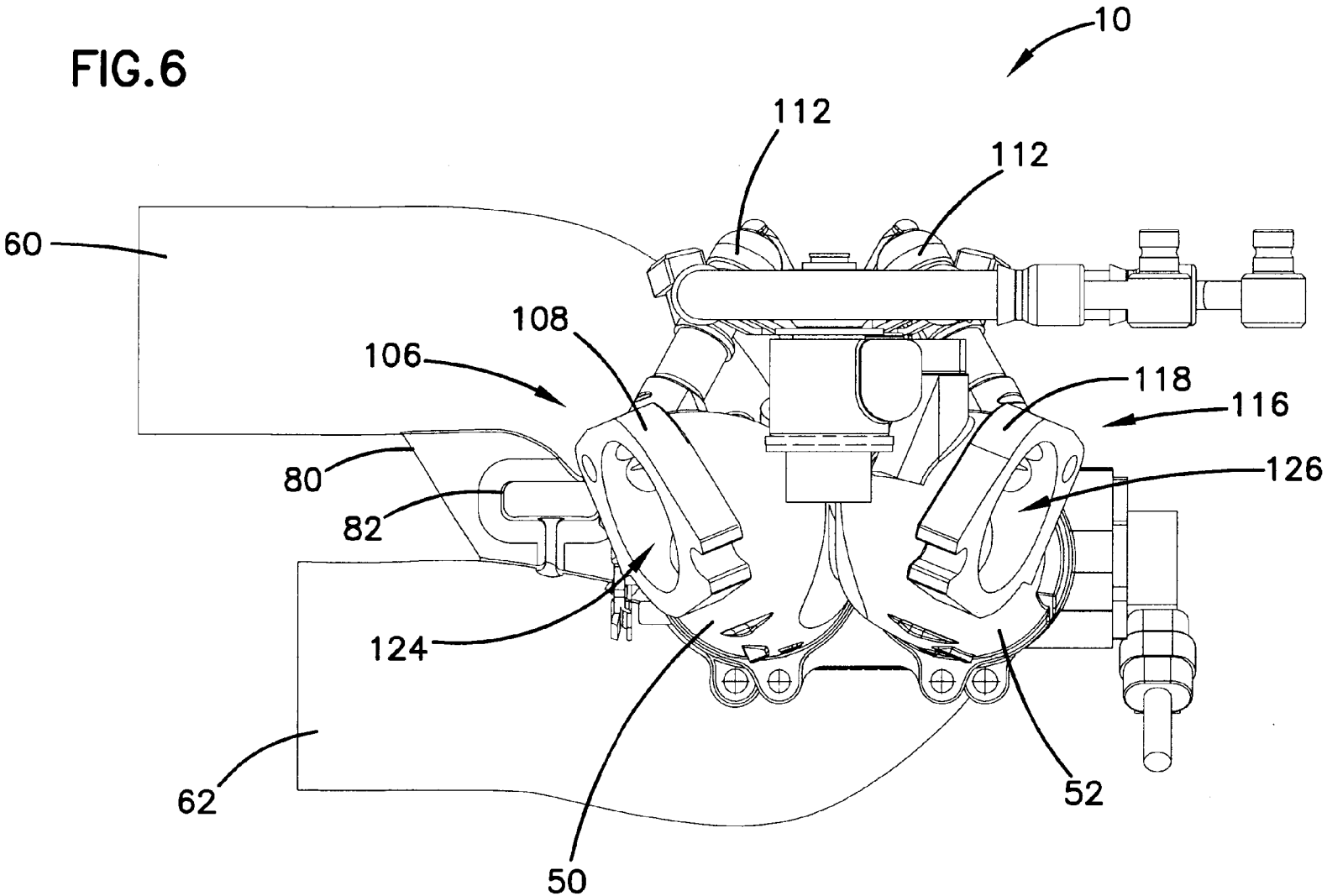
FIG. 6 is a left side elevational view of the tuned induction system shown in FIG. 5.

Referring now to FIGS. 2, 6 and 7, each of the front and rear manifolds 50 and 52 of the tuned induction system 10 are positioned in a generally horizontal position extending out the side of the V-shaped space 44 of the V-twin engine 16.

The front manifold 50 includes an elongated body 104 having a charge intake end 106 opposite the air intake end 100. The air intake end 100 includes lugs 98' (best shown in FIG. 4) that correspond to lugs 98 of the throttle body 54. In the illustrated embodiment, the front manifold 50 has two corresponding lugs 98' that extend radially from the elongated body 104. The elongated manifold body 104 of the front manifold 50 couples to the throttle body 54 to continue the airflow passage from the individual air intake runner 60.

The charge intake end 106 of the manifold body 104 includes an integral flange 108. The integral flange 108 couples or bolts to the inner face 40 of the front cylinder head 30. Because of the V-twin engine configuration, the airflow passage to the cylinder heads must again be redirected. Specifically, the airflow entering the manifold bodies and flowing in the direction along the longitudinal axis b—b of the induction system must be re-directed toward either the front or rear cylinder heads 30 and 32 in a forward or rearward direction (a direction perpendicular to the longitudinal axis b—b and parallel to the transverse axis a—a). The charge intake end 106 of the front manifold body 50 therefore curves outward and obliquely downward to couple to the inner face 40 of the front cylinder head 30.

Similarly, the rear manifold 52 includes an elongated body 114 having a charge intake end 116 opposite the air intake end 102. The air intake end 102 includes lugs 98' that correspond to lugs 98 of the throttle body 54. In the illustrated embodiment, the rear manifold 52 has two corresponding lugs 98' that extend radially from the elongated body 114. The elongated manifold body 114 of the rear manifold 52 couples to the throttle body 54 to continue the airflow passage from the individual air intake runner 62.

The charge intake end 116 of the rear manifold body 114 also includes an integral flange 118. The integral flange 118 couples or bolts to the inner face 42 of the rear cylinder head 32. To re-direct airflow, the charge intake end 116 of the rear manifold body 52 curves outward and obliquely downward to couple to the inner face 42 of the rear cylinder head 32.

In the illustrated embodiment, each of the front and rear manifold bodies 50 and 52 have length $L_1$ measured from the air intake end 100 and 102 to the charge intake end 106 and 116. Experimentation to increase engine performance has shown that the length $L_1$ is preferably within the range of 3.5 inches and 5.5 inches. More preferably the length is between 4 pinches and 5 inches. Most preferably, the length is about 4.5 inches. The preferred length of each manifold 50, 52 is such that the overall length of each air passage of the induction system enables pressure waves to propagate and air column inertia to develop to enhance engine performance.

Equally important, the radius of each of the charge intake ends 106 and 116 maintains or maximizes airflow velocity entering the cylinder heads. The integral flanges 108 and 118 of the manifolds 50 and 52 provide a continuous, non-interrupted bend radius 124 and 126. The continuous, non-interrupted bend radius of each manifold provides a clear airflow passage that assists in maximizing or maintaining airflow velocity. What is meant by clear airflow passage is that the airflow passage smoothly transitions and is unobstructed or free of objects or structures that may disrupt airflow.

Experimentation to increase engine performance has shown that the curved intake ends preferably have a centerline radius of between 1.25 inches and 1.75 inches. More preferably the radius is about 1.5 inches. This integral flange feature of the tuned induction system is an important factor in enhancing engine performance, as is hereinafter described.

D. Fuel Injectors

In the illustrated embodiment of FIG. 4, the tuned induction system 10 includes a fueling mechanism having fuel injectors 112 that inject fuel into the airflow within the front and rear manifolds 50 and 52. Fuel is supplied to the fuel injectors 112 from the fuel tank by a pump (not shown) through a system that includes a pressure regulator (not shown) for regulating the pressure of fuel supplied to the fuel injectors. The fuel tank is connected to the fuel injectors 112 through respective fuel supply lines 120 and a fuel rail 130.

In the preferred embodiment, each fuel injector 112 is located adjacent the charge intake end 106 and 116 of each manifold body 104, 114. Discharge nozzles (not shown) of the fuel injectors extend into the manifold body near the integral flanges 108 and 118. The fuel injectors 112 are set so that the spray axes will pass towards the center of the airflow passage and into the intake port of the cylinder heads. Each fuel injector is configured to spray fuel equally into each of the airflow passages so as to provide uniform charge strength entering each of the front and rear cylinder heads. The rate of fuel injection is controlled by an electronic control module (not shown) and based on inputs such as, for example, engine rpm and throttle position.

To minimize emissions, fuel injectors are preferably targeted to spray fuel on a backside of an intake valve of the cylinder head. The integral flange feature of the present invention facilitates improved injector targeting by allowing the injector to be placed closer to the intake port of the cylinder head. This permits more of the fuel spray to contact the backside of the intake valve than is possible with manifolds having conventional mounting flanges.

IV. Operation of Conventional Intake Designs

To provide context to the present invention, a description of conventional designs and their operation follows. Conventional intake designs are illustrated in FIGS. 8–10.

Figure 9:
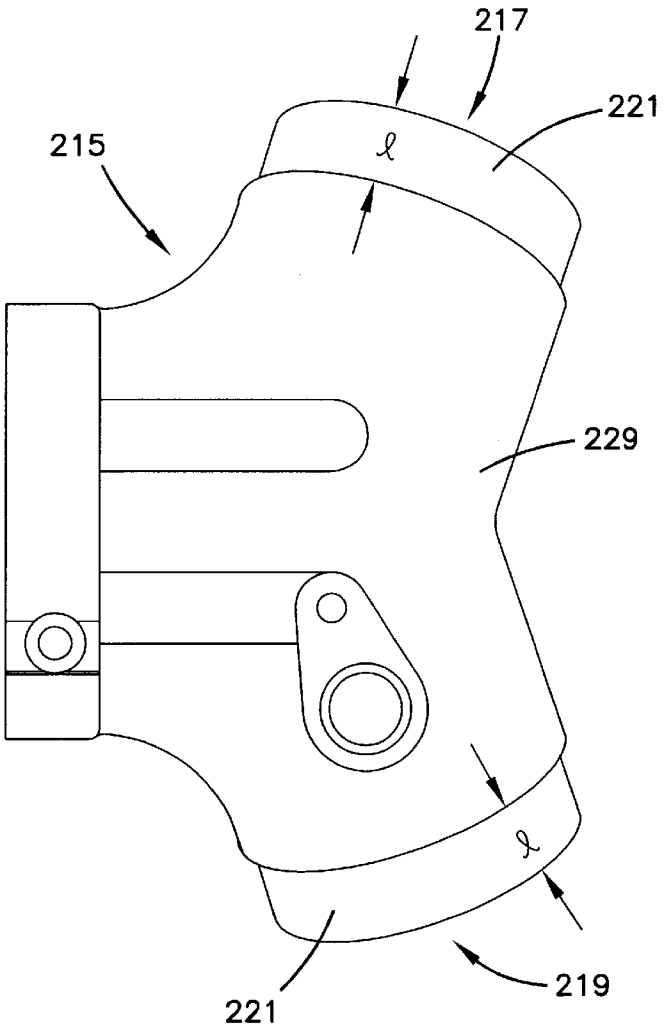
FIG. 9 (Prior Art)
FIG. 9 is a top plan view of the induction system of FIG. 8.
Figure 8:
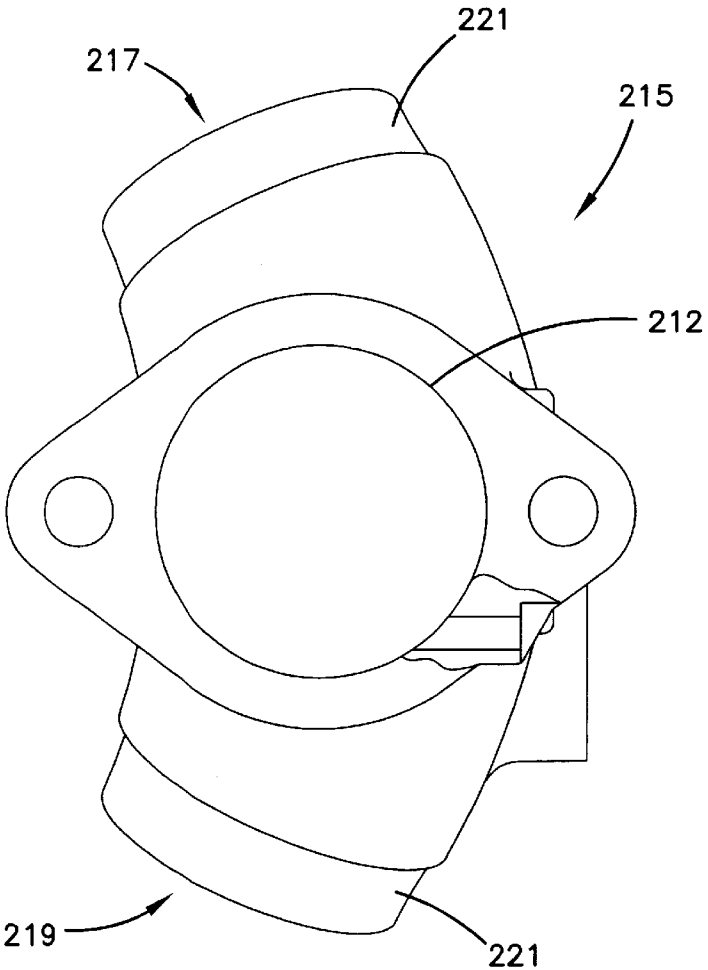
FIG. 8 (Prior Art)
FIG. 8 is a side elevational view of one induction system known to those skilled in the art.

FIGS. 8 and 9 illustrate one conventional intake design used on a V-twin engine. This type of Y-manifold design 215 typically includes a single intake port 212 and a Y-shaped body 229. The Y-manifold 215 shown is a single piece construction that has two manifold ports 217 and 219 that mount to the intake ports of front and rear cylinder heads. Separate mounting flanges (not shown) are required to mount the Y-manifold to the intake ports of the cylinder heads. As is typical with such conventional mounting designs, a straight flange portion 221 is needed to couple the Y-manifold 215 with separate mounting flanges to the cylinder heads. The straight flange portions 221 commonly require nearly ½ inch of straight manifold length l at each port 217, 219. Thus a much tighter bend is required to mate the Y-manifold with the cylinder intake port within the narrow constraints of the 45-degree V-twin engine.

The required straight manifold length l and therewith tight bend, introduce a restriction of airflow to the cylinder heads. This airflow restriction is magnified on engines with larger diameters or shorter cylinders that have even less space between the engine's V-shape configuration. The narrow confines of the 45-degree V-twin engine is the primary reason why the conventional Y-manifold configuration has continued despite the disadvantages of airflow restrictions and lack of intake tuning or utilization of pressure waves and air column inertia.

Figure 10:
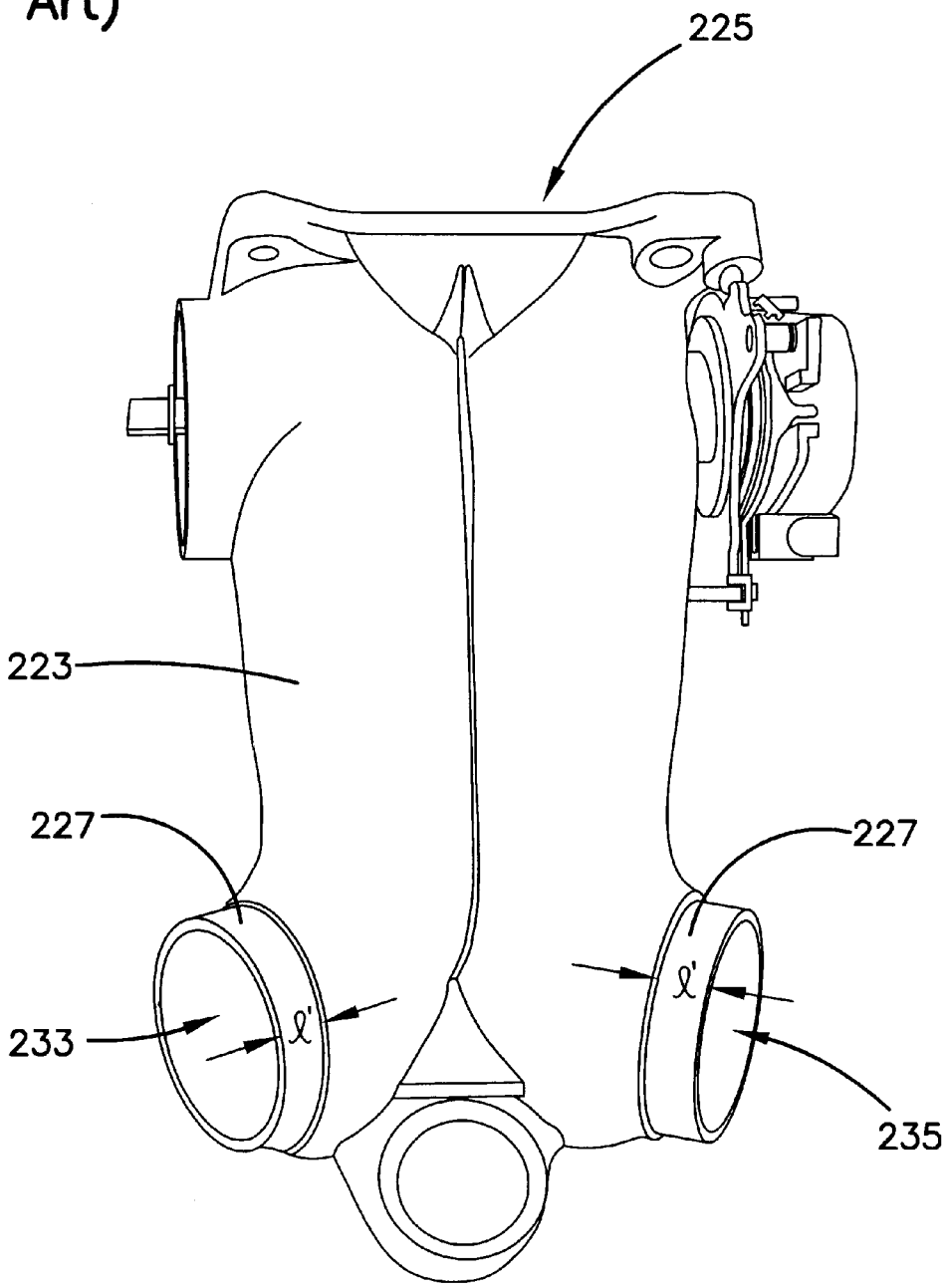
FIG. 10 (Prior Art)
FIG. 10 is a bottom plan view of another induction system known to those skilled in the art.

FIG. 10 illustrates another conventional intake design used on a V-twin engine. This design has a single piece construction with an integral throttle body portion 225 and a manifold portion 223 having air passageways 233 and 235. Each air passageway extends from a common airflow source located forward from the throttle body portion 225. Conventional mounting flanges (not shown) are required to mount the manifold 225 to the intake ports of front and rear cylinder heads. Similar to the design shown in FIGS. 8 and 9, this design has straight manifold portions 227 that require a straight length l' for mounting the intake onto the cylinder heads. The straight manifold portions 227 introduce a sharp bend and airflow restriction within the air passageways, which reduces engine performance.

V. Operation of the Tuned Induction System

Referring now to the present invention, the tuned induction system bolts onto the intake ports of the cylinder heads 30 and 32. Specifically, the integral flanges 108 and 118 of the front and rear manifolds 50 and 52 bolt to the inner faces 40 and 42 of the front and rear cylinder heads 30 and 32, respectively. On an intake stroke, air is drawn through the airflow passage of the tuned induction system 10 and into the intake ports and engine cylinders.

The tuned induction system 10 provides several structural advantages as well as operational advantages.

A. Some Structural Advantages

One advantage of the tuned induction system relates to the design of the integral flange 108, 118. The integral flange permits two separate individual manifold bodies to fit within the 45-degree envelope of a V-twin engine. To illustrate, each individual separate manifold body 50 and 52 has a complete circumferential wall. Both of these manifolds—the equivalent of four wall thicknesses plus the air passage diameters—must fit within the space between the cylinders heads. Conventional single-piece manifolds, the equivalent of three wall thicknesses, plus the air passage diameters and the extended straight lengths, currently fit within the space. Use of conventional separate mounting flanges requires the additional manifold straight length (i.e. the lengths l the l' of FIGS. 9 and 10) for mounting purposes. The integral flange of the present invention is not limited by the requirement of a straight length.

Another advantage of the tuned induction system relates to the separation of intake manifold bodies. Because the manifold bodies are separate and individual, each manifold can compensate for or accommodate typical machining variances and machining tolerance stack-ups inherent in machinery assemblies. For example, one cylinder head may have a total stacked height or vertical dimension relative to the frame assembly that is different than the other cylinder head. Because the separate manifold bodies of the present invention are not in a fixed relationship, such assembly variances are more easily accommodated.

Additionally, conventional designs can have leakage problems due to engine expansion. As the operational temperature of the engine rises, some engine components may expand. This can cause geometric changes in relationship between the location of the cylinder head ports and the manifold ports. Because the ports of conventional single-piece manifolds are in a fixed relationship, the conventional manifolds cannot compensate for heat expansion of an engine. The tuned induction system addresses this problem by providing separate individually mounted manifold bodies that independently compensate for engine expansion.

More importantly, the integral flange of the present invention provides an increased bend radius and greater airflow capacity than that of the single-piece manifolds. The increased bend radius improves airflow characteristics compared to manifolds having a conventional mounting flange that introduce a restrictive bend and halt airflow velocity. Airflow velocity and energy derived from the improved airflow characteristics of the present invention enhance engine performance by exploiting the effects of pressure waves and air column inertia, as hereinafter discussed.

Overall, the integral flange configuration of the present invention increases airflow within two separate air passageways while still fitting within the narrow confines of the V-twin engine. Some operational advantages of this design are discussed in greater detail hereinafter.

B. Some Operational Advantages

The present invention provides the advantages of ram intake and benefits from the effects of pressure waves and air column inertia. Specifically, the air intake passages of the present invention are "tuned" or designed to provide maximum power through out the range of engine rpms. The overall air intake passage of the illustrated embodiment has individual linear ram intake portions that transition to angled portions extending either downward or upward toward the throttle body. The throttle body extends the air intake passages into the elongated manifold bodies that obliquely transition downward toward the 45-degree cylinder heads. The overall length of the continuous intake passage for each of the front and rear cylinder heads is substantial in comparison to conventional designs. The length and radii configurations of the tuned intake passages maximize airflow velocity and contribute to the performance of the engine by enhancing airflow characteristics.

Similarly, the configuration of the tuned induction system improves engine volumetric efficiency (increased horsepower and torque) by utilizing the inertia of the moving air column within the induction system. Additionally, pressure waves that propagate back and forth within the length of the induction system are utilized to ram additional air into the cylinder. By designing the induction system with separate manifold bodies and air intake runners (each of a length designed to maximize this effect), a reflected high pressure wave is designed to arrive at approximately bottom dead center of the intake stroke of each cylinder head to increase cylinder filling. In particular, the overall air passage length of the tuned induction system is designed to optimize the timing of the pressure waves and increases air column inertia. This in turn, enhances airflow and increases the hp and torque over the entire operating range of the engine.

Additionally, by separating the manifolds, cross-communication is eliminated. For instance, manifolds having a common airflow passageway can experience cross-communication or airflow disruptions from reciprocation of both front and rear cylinder heads during the air intake cycles. Separate air intake passages corresponding to only one cylinder head and therein only one reciprocating air intake cycle, as disclosed by the present invention, do not experience cross-communication caused by the intake cycle of another cylinder head.

Also, the separate manifold bodies and separate air intake passages enhance the fuel-air charge purity, thus improve engine performance. The fuel-air charge purity is enhanced whereby the entire fuel-air charge is received by only one cylinder head during air intake, rather than possibly being diluted or disrupted by cross-communication.

Moreover, the tuned induction system of the present invention enhances engine performance without impacting fuel economy, emissions, or engine durability, in contrast to aggressive camshaft profiles, high compression ratios or other forms of power enhancements known to those skilled in the art.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An air induction apparatus for use on a V-twin motorcycle engine having a first cylinder head and a second cylinder head, the induction apparatus comprising:

a) a first intake air passage, the first intake passage including:

i) a first intake runner; and ii) a first main intake portion, the first main intake portion sized to fit between the first and the second cylinder head of the V-twin engine, the first main intake portion having an integral flange located at an end, the integral flange being configured to mount to the first cylinder head of the V-twin engine; and b) a second intake air passage, the second intake passage including:

i) a second intake runner; and ii) a second main intake portion, the second main intake portion sized to fit between the first and second cylinder heads of the V-twin engine, the second main intake portion having an integral flange located at an end, the integral flange being configured to mount to the second cylinder head of the V-twin engine.

2. The air induction apparatus of claim 1, further including fuel injectors located adjacent the integral flanges that spray fuel into the airflow within the air intake passages to provide a combustible fuel-air charge.

3. The air induction apparatus of claim 1, wherein each main intake portion includes a flange region at which the integral flange is located, the flange region having a continuous curved radius extending from the main intake portion and along the flange region, the continuous curved radius permitting clear airflow.

4. The air induction apparatus of claim 1, wherein the air induction system further includes a throttle body have a first bore and a second bore, the first bore being in fluid communication with the first air intake passage, the second bore being in fluid communication with the second air intake passage.

5. The air induction apparatus of claim 1, wherein each of the first and second intake air passages further includes:

a) a ram-air portion located at an open end of the intake runners;

b) a first transition portion curving from the ram-air portion toward the main intake portion, the first transition portion configured to provide a first substantially perpendicular directional transition of the airflow through the air passages from the ram-air portion toward the main intake portion; and c) a second transition portion curving obliquely downward from the main intake portion toward the cylinder head, the second transition portion configured to provide a second substantially perpendicular directional transition of the airflow through the air passages from the main intake portion to the cylinder head.

6. The air induction apparatus of claim 1, wherein the first main intake portion and the second main intake portion are defined by separate first and second bodies, the first body being in fluid communication with the first intake runner, the second body being in fluid communication with the second intake runner.

7. An air intake system for use on a V-twin motorcycle engine having a front cylinder head and a rear cylinder head, the intake system comprising:

a) a front manifold body defining a first air intake passage, the front manifold body including an end adapted to couple to the front cylinder head;

b) a rear manifold body defining a second air intake passage, the rear manifold body including an end adapted to couple to the rear cylinder head;

c) an air intake structure;

d) a throttle body positioned between the front and rear manifold bodies and the air intake structure, the throttle body providing fluid communication between the air intake structure and the first and second air intake passages of the front and rear manifold bodies; and e) a fuel mechanism that delivers fuel to the first and second air intake passages.

8. The air intake system of claim 7, wherein the front manifold body and the rear manifold body each include integral flanges adjacent the ends of the front and rear manifold bodies, the flanges being adapted to couple each of the front and rear manifold bodies to the respective front and rear cylinder heads.

9. The air intake system of claim 8, wherein each of the front and rear manifolds includes an internal bend adjacent the ends, the internal bend having a continuous radius extending along the integral flange for providing increased airflow.

10. The air intake system of claim 8, wherein the fuel mechanism includes fuel injectors located adjacent the integral flanges.

11. The air intake system of claim 7, wherein the air intake structure includes a front intake runner and a rear intake runner, the front intake runner being in fluid communication with the front manifold body, the rear intake runner being in fluid communication with the rear manifold body.

12. The air intake system of claim 11, wherein each of the front and rear intake runners includes a ram-air portion having an opening at an open end, the open end of the ram-air portion extending forward in a first direction.

13. The air intake system of claim 12, wherein each of the front and rear intake runners further includes a transition portion, the transition portion of the front intake runner curving downward and inward toward a second direction substantially perpendicular to the first direction, the transition portion of the rear intake runner curving upward and inward toward the second direction substantially perpendicular to the first direction.

14. A motorcycle, comprising:

a) a frame assembly, and a front wheel and a rear wheel connected to the frame assembly;

b) an internal combustion engine having a first cylinder head and a second cylinder head, the first and second cylinder heads arranged in a V-shape configuration; and c) an air intake system adapted to couple within a space provided between the first and second cylinder heads, the air intake system including:

i) a first air intake passage, the first air intake passage having:

1) a first air intake column; and 2) a first manifold in fluid communication with the first air column, the first manifold having an elongated body and an integral flange adapted to couple to the first cylinder head;

ii) a second air intake passage, the second air intake passage having:

1) a second air intake column; and 2) a second manifold in fluid communication with the second air column, the second manifold having an elongated body and an integral flange adapted to couple to the second cylinder head.

15. The motorcycle of claim 14, wherein the integral flange is oriented at an angular offset from a longitudinal axis of the manifold body, the flange including a curved radius that continues from a curved end of the elongated body.

16. The motorcycle of claim 15, wherein the curved radius of the flange is continuous with the curved end of the elongated body to provide a directional transition surface within the manifold that maximizes airflow velocity.

17. The motorcycle of claim 15, further including fuel injectors located adjacent the integral flanges that spray fuel into the airflow exiting the first and second air intake passages.

18. The motorcycle of claim 14, wherein the air intake system further includes a throttle body have a first bore and a second bore, the first bore being in fluid communication with the first air intake column and the first manifold, the second bore being in fluid communication with the second air intake column and the second manifold.

19. The motorcycle of claim 14, wherein each of the first and second air intake passages includes:

a) a ram-air portion located at an open end of the intake columns;

b) a first transition portion curving from the ram-air portion toward the manifold, the first transition portion configured to provide a first substantially perpendicular directional transition of the airflow through the air passages from the ram-air portion toward the manifold; and c) a second transition portion curving obliquely downward from the manifold toward the cylinder head, the second transition portion configured to provide a second substantially perpendicular directional transition of the airflow through the air passages from the manifold to the cylinder head.

20. The motorcycle of claim 14, wherein the V-shape configuration of the first and second cylinder heads includes the first cylinder being arrange at approximately 45-degrees relative to the second cylinder head.

* * * * *